United States Patent [19]

Andrews

[11] 4,013,059

[45] Mar. 22, 1977

[54] FACTORY-BUILT FIREPLACE WITH FLUSH HEARTH INSTALLATION

[75] Inventor: George M. Andrews, Syracuse, N.Y.

[73] Assignee: Vega Industries, Inc., Syracuse, N.Y.

[22] Filed: July 7, 1975

[21] Appl. No.: 593,799

[52] U.S. Cl. ..... 126/120; 126/131; 126/312; 98/60

[51] Int. Cl.[2] ..... F24B 1/18

[58] Field of Search ..... 126/120, 121, 129, 130, 126/131, 312; 237/51; 98/58, 60

[56] References Cited

UNITED STATES PATENTS

| | | | |
|---|---|---|---|
| 2,821,975 | 2/1958 | Thulman | 126/120 |
| 3,744,477 | 7/1973 | Andrews | 126/120 |
| 3,896,785 | 7/1975 | Nelson | 126/121 |

*Primary Examiner*—Ronald C. Capossela
*Attorney, Agent, or Firm*—Charles S. McGuire

[57] ABSTRACT

A factory-built fireplace for permanent, fully-enclosed installation which takes cooling air from the room in which it is installed, but has no cooling air inlet openings below the front of the hearth. All necessary cooling air enters through openings in the front wall along each side of the combustion chamber into an air passage from which the major portion flows into a space under the hearth floor. After flowing centrally and rearwardly to provide the necessary cooling under the hearth, this air flows upwardly through enclosed spaces at the rear of the combustion chamber to cool this portion of the fireplace. A second portion of the air from the aforementioned air passage may enter enclosed spaces behind the side walls of the combustion chamber to provide the necessary cooling of this portion of the fireplace.

10 Claims, 7 Drawing Figures

FACTORY-BUILT FIREPLACE WITH FLUSH HEARTH INSTALLATION

BACKGROUND OF THE INVENTION

The present invention relates to prefabricated or factory-built fireplace units intended for permanent installation, enclosed by combustible materials.

Fireplace units are commonly constructed of sheet metal, with hearth floors and sometimes rear firebox walls of refractory material, and shipped ready for installation in a building already existing or under construction. Such fireplaces are often enclosed by wood or other combustible materials and it is desirable, for maximum economy of space, that no clearance be required between the fireplace shell and the combustible materials. This requires, of course, that the outer shell of the fireplace remain cool enough to insure that an unsafe condition does not result.

Besides providing a layer of insulating material inside the fireplace shell which contacts the combustible materials, space is commonly provided for circulation of air behind the side and rear walls of the combustion chamber and beneath the hearth. In order to provide such cooling air in sufficient quantity at the required locations, air intake openings are provided below the hearth, and sometimes at other locations as well. This requires that the hearth be elevated above the level of the floor or hearth extension and that the air intake openings remain unobstructed. Besides the fact that there is a substantial possibility of inadvertently blocking these openings at or near floor level, a more esthetically acceptable appearance could be achieved by having the hearth flush with the floor or hearth extension.

It is a principal object of the present invention to provide a prefabricated fireplace construction which may be safely installed with zero clearance to combustibles which requires no inlet openings for cooling air below the front of the hearth.

Another object is to provide a factory-built fireplace unit with intake openings for cooling air which do not detract from the appearance of the fireplace and are so positioned that obstruction is unlikely.

A further object is to provide a factory-built fireplace having air intake openings for continual circulation of cooling air around the firebox with an internal structure directing the path of the air to achieve optimum cooling effect.

Other objects will in part be obvious and will in part appear hereinafter.

SUMMARY OF THE INVENTION

In accordance with the foregoing objects, the invention comprises a factory-built fireplace unit constructed principally of sheet metal with the usual open-front combustion chamber defined by a hearth floor, side and rear walls. Enclosed spaces with passages for cooling air around the combustion chamber are provided by walls with openings and baffle structures positioned to direct the air in a controlled path under the hearth and behind the side and rear walls.

The air intake openings are provided in front walls on each side of the firebox opening, where they are covered by the usual flexible screen and thus do not detract from the appearance of the unit. The vertical wall in which the intake openings are provided cooperates with other elements of the structure to form an internal air passage. The hearth is elevated to provide a space thereunder for flow of cooling air from the air passage. A system of baffles insures that the air passes under all portions of the hearth before passing out of the space thereunder and upwardly through another enclosed space behind the rear wall of the combustion chamber. Besides the air which passes under the hearth, a smaller portion of the air entering through the intake openings passes behind the side walls of the combustion chamber to provide cooling of this portion of the fireplace. After passing under the hearth and behind the side and rear walls, the air enters the flue through a system of louvers in the hood and is exhausted with the products of combustion.

DETAILED DESCRIPTION

Figure 1:
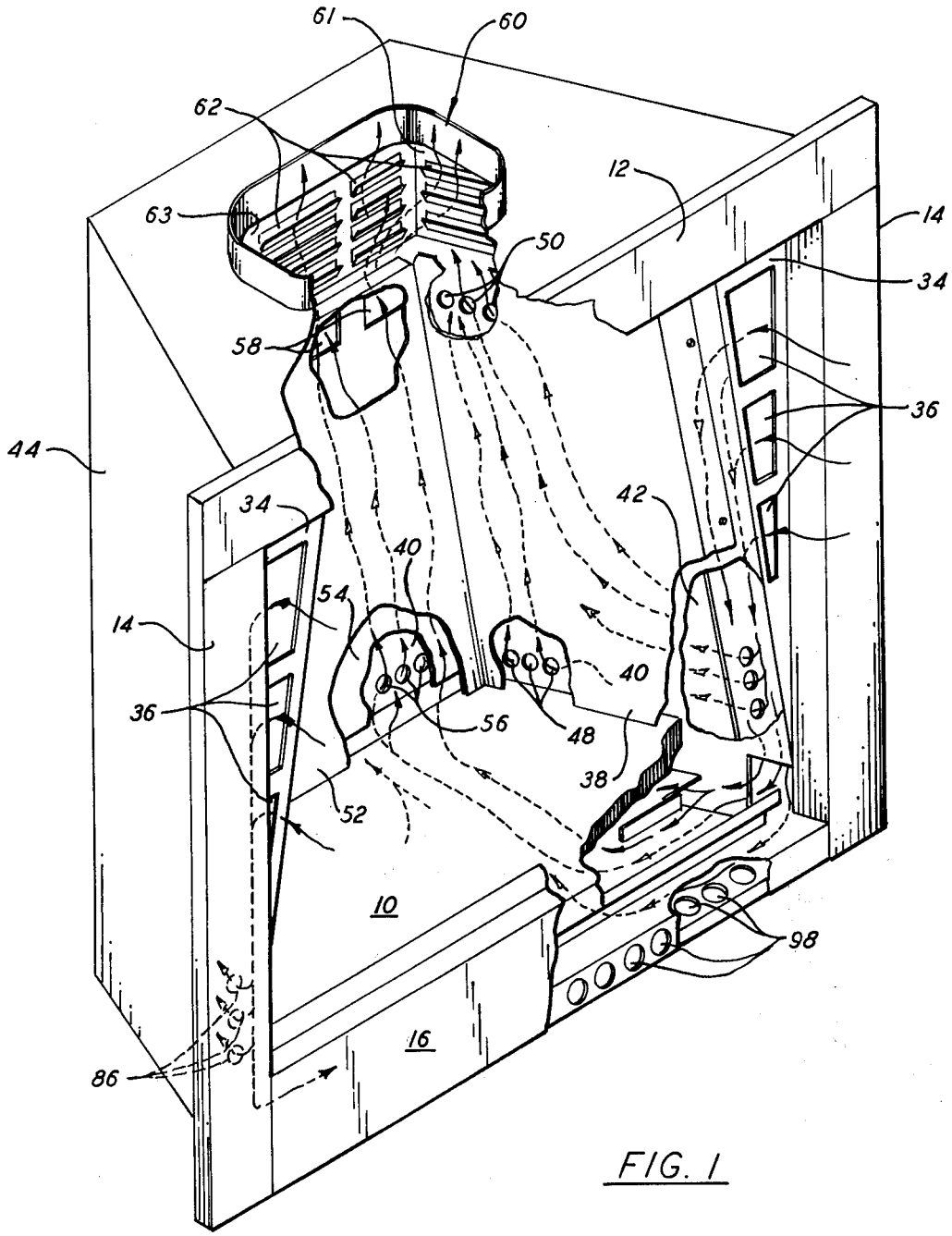
FIG. 1 is a perspective view, with portions broken away, of a fireplace construction embodying the present invention.
Figure 2:
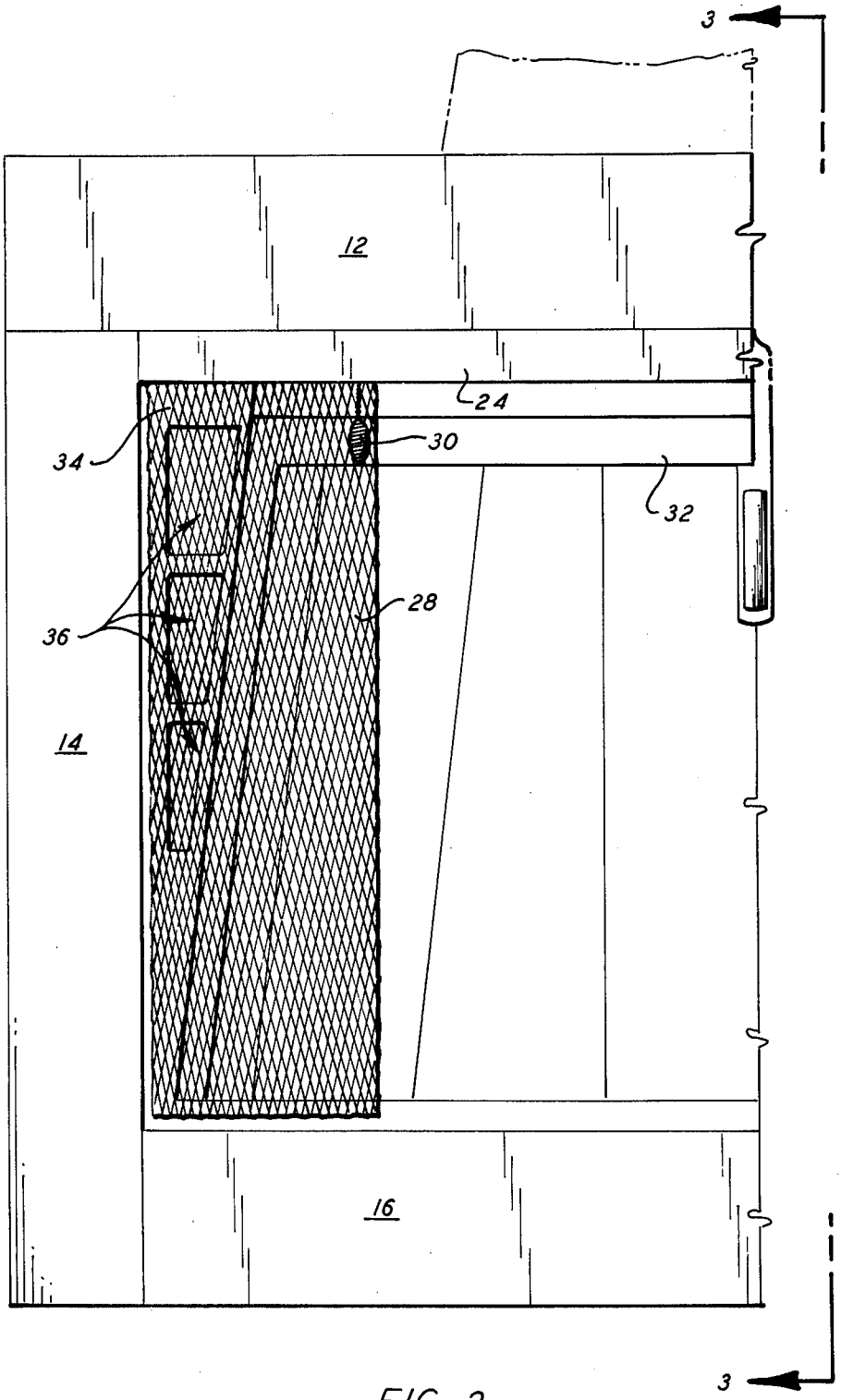
FIG. 2 is a front elevational view of the fireplace of FIG. 1, on one side of the centerline only.

A complete fireplace structure which incorporates the present invention is illustrated in FIG. 1, with certain portions broken away in order to show as much constructional detail as possible. The fireplace has the usual open-front firebox or combustion chamber defined by a hearth floor 10, two side walls and a rear wall; the side and rear walls include a number of elements, each of which will be described in detail later herein. The illustrated fireplace is symmetrical on each side of a vertical plane passing from front to rear through the center of the front opening. Hearth floor 10, in accordance with usual practise, consists of a slab of refractory material poured into a metal pan 11 and permanently hardened. The remaining elements are formed of sheet metal of appropriate gauge and finish.

Figure 3:
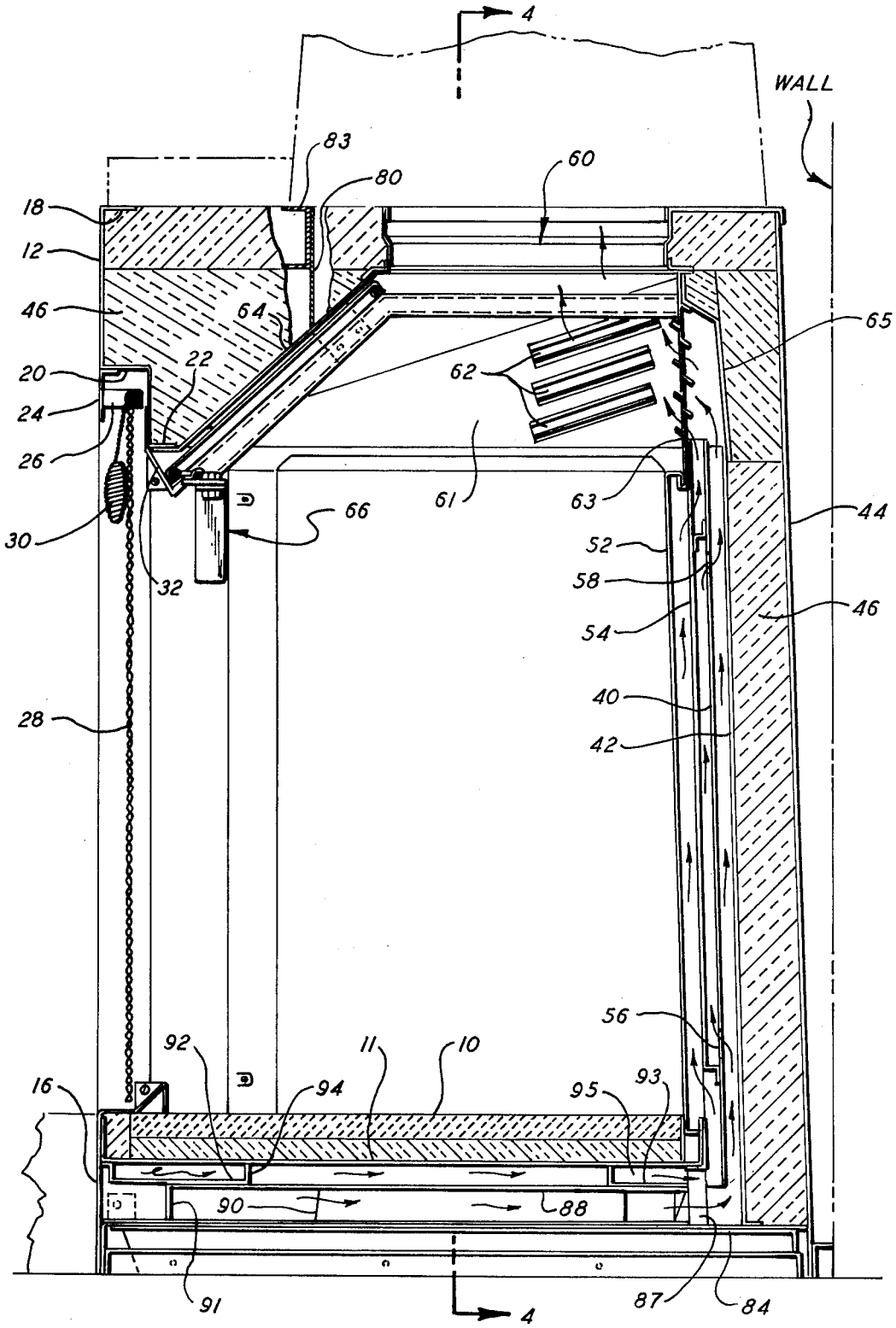
FIG. 3 is a side elevation in full section on the line 3—3 of FIG. 2.

The front opening is surrounded by a face plate including top 12, sides 14, and lower portion 16. As best seen in FIG. 3, top portion 12 of the face plate is bent rearwardly at the top to form lip 18, and at the bottom is bent rearward, downward, and again rearward, forming horizontal lips 20 and 22, with a vertical section between. Affixed to the lower side of lip 20 is plate 24, holding track 26 upon which two-piece, flexible screen 28 is mounted for sliding movement between covering and uncovering positions with respect to the front fireplace opening. Handles 30 are attached to each section of screen 28 for movement thereof. The fireplace is shown in FIG. 1 without the screen. Plate 32 is affixed to the portion of top member 12 which extends vertically between horizontal lips 20 and 22.

Face columns 34 are arranged inwardly adjacent side members 14 of the face place. Columns 34 have a configuration best seen in FIG. 5, and described in detail later herein, comprising essentially vertical walls defining the front sides of the fireplace front opening.

One portion of each column 34 is provided with openings 36 for the free passage of air into a chamber partially defined by the interior surfaces of columns 34, as will later become apparent.

Each side of the combustion chamber includes wing panel 38, inner shell 40, middle shell 42, and outer shell 44. All of middle and outer shells are formed with two side and a rear wall portions, each joined along a vertical line at the rear center of the fireplace. Thus, each shell extends along both sides and the rear of the combustion chamber. The shells are substantially parallel to and spaced from one another, sloping inwardly toward the top and also toward the rear. The space between middle shell 42 and outer shell 44 is filled with a suitable insulating material 46, the space between inner shell 40 and middle shell 42 being open, as is the space between the wing panel 38 and inner shell 40. Openings 48 and 50 are provided at the bottom and top, respectively, near the rear of each of the side portions of inner shell 40. A portion of such openings may be seen in FIG. 4 due to the inward slope toward the rear of the shells and wing panel.

The construction at the rear of the fireplace is best seen in FIG. 3, wherein the rear sections of inner, middle and outer shells 40, 42 and 44, respectively, are shown. Liner 52 forms the rear wall of the combustion chamber and is attached to liner control shield 54, which in turn is affixed to inner shell 40. Materials and constructional details of this portion of the fireplace unit may be essentially the same as those set forth in U.S. Pat. No. 3,744,477 of the present inventor. Lower and upper openings 56 and 58, respectively, in inner shell 40 provide for air flow between the inner shell and control shield 54. Appropriate openings or passages are provided to allow air flow upwardly between control shield 54 and the rear surface of liner 52. Air flowing rearwardly under the hearth, as explained later, enters at the bottom both in front of and behind inner shell 40 to provide cooling of liner 52 and the other elements at the rear of the fireplace.

Figure 4:
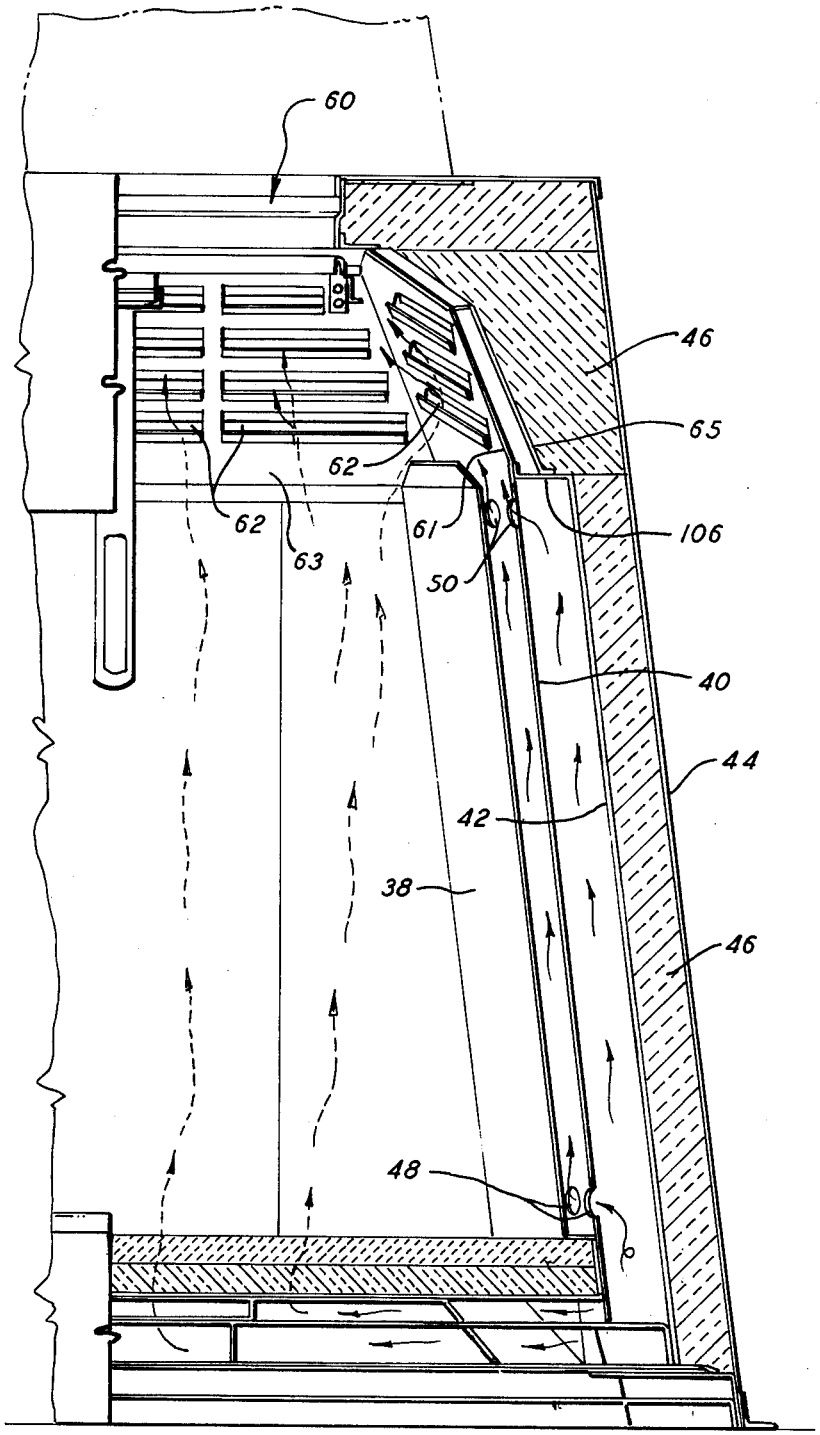
FIG. 4 is a front elevation in full section on the line 4—4 of FIG. 3, showing the fireplace on one side of the centerline only.
Figure 7:
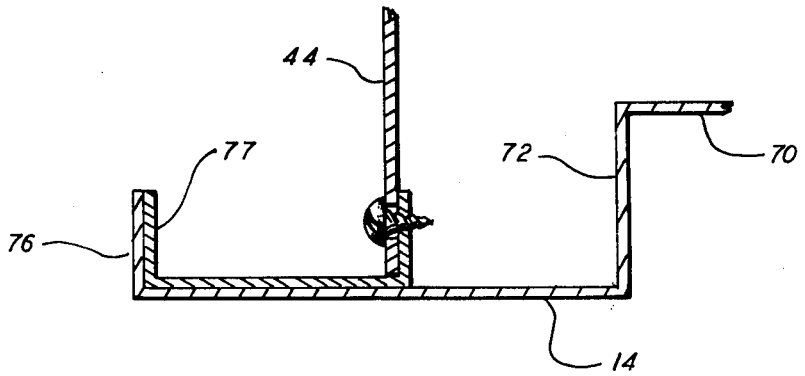
FIG. 7 is a plan view in section on the line 7—7 of FIG. 5.

As shown in FIGS. 1, 3 and 4, an inner hood structure is provided to form a continuous duct from above the combustion chamber to flue opening 60, to which the chimney sections are connected. Side walls 61 of the hood extend from the upper edges of each side portion of inner shell 40 (FIG. 4) and rear wall 63 of the hood extends upwardly from a cooperative fit with liner 52, substantially in the plane of control shield 54 (FIG. 3). Side and rear walls 61 and 63 are each provided with a system of louvered openings 62 to allow cooling air which has risen up the sides and rear outside the combustion chamber to enter the flue area for exhaust through the chimney. Front hood section 64 (FIG. 3) joins the two side walls 61 at the front to complete the duct section provided by the hood. Hood spacer 65 is provided in spaced, substantially parallel relation to side walls 61 and rear wall 63 of the hood in order to keep insulation 46 spaced therefrom and maintain the air flow passage outside of openings 62. Insulation 46 is also provided in the space between section 64 and top member 12 of the face plate. A damper assembly, denoted generally by reference numeral 66, is mounted for selective movement between open and closed positions with respect to flue opening 60. As shown in FIG. 7, outer shell 44 is affixed with respect to column 34 by screws which attach the forward edge of the outer shell to bracket 77. The latter is permanently affixed by spot welding, or other convenient means to rear surfaces of column 34.

Figure 5:
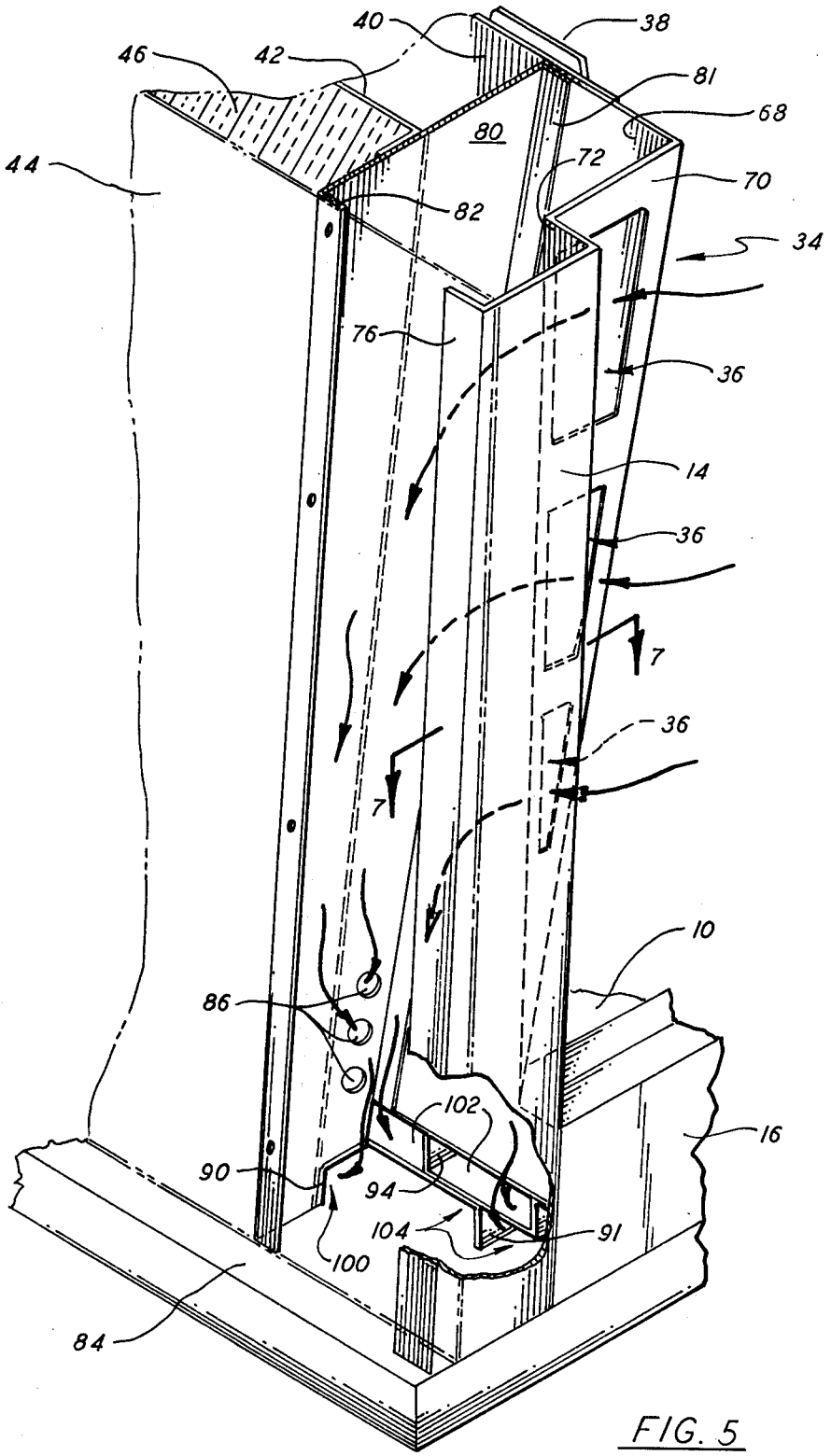
FIGS. 5 and 6 are enlarged, fragmentary, perspective views, with portions broken away, of certain elements of the fireplace structure.
Figure 6:
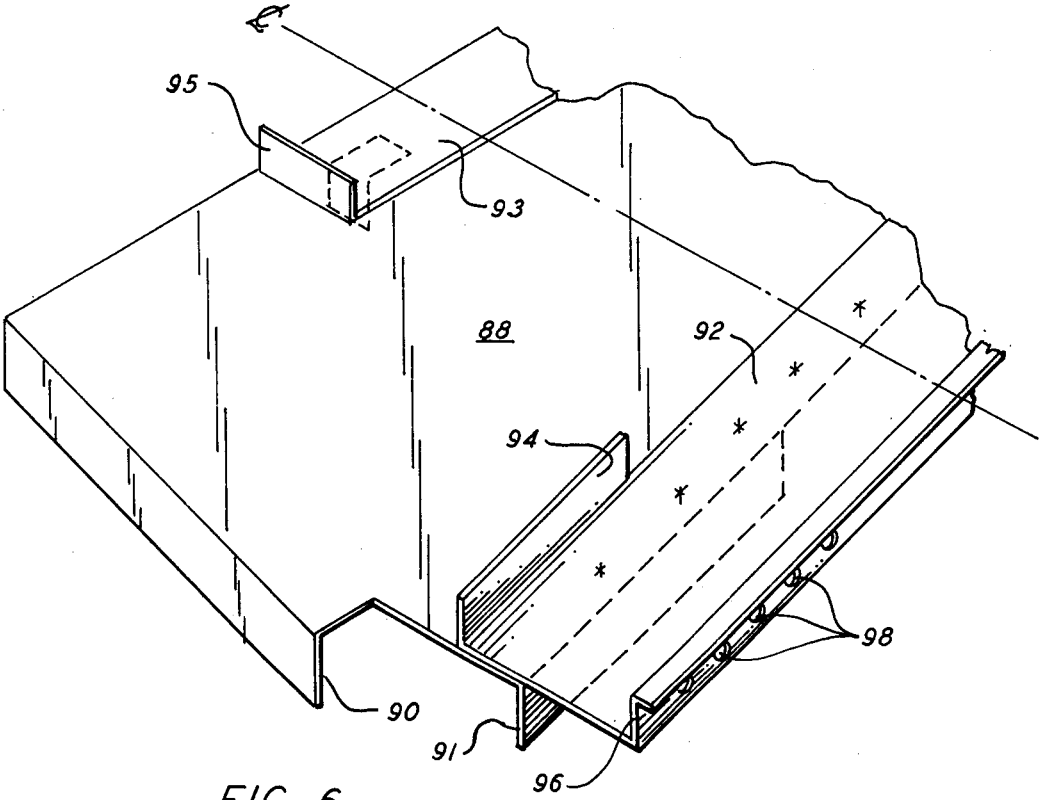

Turning now to FIGS. 5 and 6, the air flow system providing the necessary cooling effect is shown in greater detail. Column 34 includes wall 68, substantially contiguous with the front edge of inner shell 40, wall 70, which includes openings 36, and walls 72, 14 and 76. It will be noted that wall 14 of column 34 forms the previously mentioned sides of the face plate defining the frontal fireplace opening. Wall 70 is progressively narrower, and thus openings 36 are progressively smaller, towards the lower end of the column. Post 80 is provided with flanges 81 and 82 at each side for attachment to inner and outer shells 40 and 44. Post 80, and the corresponding post on the opposite front side, extends above the upper edges of shells 40, 42 and 44 and column 34. As shown in FIG. 3, post 80 extends to the fireplace top and the two posts are connected to beam 83, which assists in supporting the load on the top of the fireplace, particularly that of the chimney outer casing. The internal surfaces of column 34 cooperate with outer shell 44 and post 80 to form a chamber or passage for air entering through openings 36. Such air is directed downwardly, as indicated by the arrows, and may flow out of the air passage either to spaces under hearth floor 10 or to the space between the side portions of inner shell 40 and middle shell 42.

The elements are shown in FIG. 5 resting on skid cover 84, as the fireplace would normally be installed. Air flow to the space between the side portions of the inner and middle shells 40 and 42 is provided through openings 86 in post 80. Air flow under the hearth is provided by elevating the slab comprising hearth floor 10 above skid cover 84, and terminating the lower ends of wall 68 and post 80 so as not to obstruct the openings so formed.

The hearth is supported above skid cover 84 by affixing hearth pan 11, by screws (not shown) or the like, to walls 68 on each side at the front, and by bridge member 87 (FIG. 3) at the rear. A radiation shield and air baffle structure is provided in the space between hearth pan 11 and skid cover 84, but does not structurally support the hearth. This structure is shown in more detail in FIG. 6, and includes planar portion 88 having downwardly turned side flanges 90 and front flange 91. Affixed to planar portion 88 are additional members 92 and 93 having upwardly turned flanges 94 and 95, respectively, which contact the lower side of hearth pan 11. An upwardly turned portion 96 along the front of member 92 serves as a radiation shield, openings 98 therein being provided in conventional manner to reduce heat conduction and having no function insofar as air flow is concerned.

As best seen in FIG. 5, air may flow directly rearwardly, under planar portion 88 of the radiation shield, through opening 100 below post 80. Air may also flow laterally into the space above planar portion 88 through openings 102, and to the space below planar portion 88 through openings 104 below wall 68 of column 34. Flanges 91 and 94 on each side serve as baffles to insure that the laterally flowing air is directed toward the center of the radiation shield before moving rearwardly.

Referring again to FIG. 3, the arrows above and below planar portion 88 of the radiation shield indicate the flow of air which provides the necessary cooling below the hearth. This air flows into the spaces in front of and behind the rear section of inner shell 40 and upwardly to continue to absorb heat from the elements at the rear of the fireplace. The air rising in front of inner shell 40 passes up the rear surface of liner 52; part of the air rising behind the inner shell passes directly through the space between inner and middle shells 40 and 42, and part passes through openings 56 into the space between control shield 54 and inner shell 40, and returns through openings 58 to the space between the inner and middle shells.

Thus, essentially all of the air which enters the space under the hearth floor through the inlet means at the lower end of the air passage along the front lower corner of the combustion chamber flows out of this space through the outlet means provided along the rear edge of the hearth. The air which flows from the air passage through openings 86 in post 80 moves rearwardly and upwardly, as best seen in FIGS. 1 and 4, in the space between inner and middle shells 40 and 42. A portion of this air passes through openings 48 into the space between inner shell 40 and wing panel 38 near the lower rear corner thereof. The top of the space between inner and middle shells 40 and 42 is closed by upper wall 106 (FIG. 4); the top of the space between inner shell 40 and wing panel 38 is open. Accordingly, the air which has risen to the upper part of the space between the inner and middle shells flows through openings 50, and through the open space at the top of wing panel 38 and inner shell 40 for exhaust through the flue opening.

The total area of openings 36 is large enough to permit air flow in sufficient quantity for cooling purposes below the hearth and on the sides and rear of the combustion chamber. The minimum area required for the one or more openings, as well as other dimensions for the air flow passages, etc., may be determined empirically for a fireplace of any desired size or capacity by design and test procedures well known in the art. Openings 36 may be placed in any of the wall surfaces of column 34 to communicate with the air drop passage, providing the flow of cooling air as described. Although the location of openings 36 is not especially critical, it is desirable that they be placed so as not to detract from the external appearance of the fireplace, and not so low as to increase the possibility of inadvertent blockage, or having ashes or other foreign matter fall into the air drop passage. Finally, it is again emphasized that all the air necessary for cooling the exterior shell of the fireplace to the extent necessary for installation with zero clearance to combustibles is provided from within the room where the fireplace is installed, but without open air intake openings below the hearth.

What is claimed is:

1. A factory-built fireplace having an exterior surface defined by an outside shell for installation in a structure with zero clearance between said outside shell and combustible materials of said structure, said fireplace comprising, in combination:

a. a combustion chamber having an open front and a hearth floor;

b. a wall having exterior and interior surfaces and defining one side of the open front of said combustion chamber;

c. means, including at least a portion of the interior surface of said wall, defining an air flow passage having upper and lower ends;

d. said wall having an opening for flow of air into said air flow passage at said upper end thereof;

e. means supporting said hearth floor to define a space thereunder;

f. inlet means through which said air flow passage communicates at said lower end thereof with the space under said hearth floor; and g. outlet means defining a path for flow of air out of the space under said hearth floor in a location remote from said inlet means, the relative sizes and locations of said inlet and outlet means, said air passage and said wall opening being such that sufficient cooling air is provided solely by the air entering said wall opening.

2. The invention according to claim 1 and further including baffle means disposed in the space under said hearth floor to control the direction of air flow thereunder.

3. The invention according to claim 2 wherein said inlet means is located adjacent the intersection of the front and one side of said hearth floor.

4. The invention according to claim 3 wherein said outlet means is located adjacent the rear of said hearth floor.

5. The invention according to claim 4 wherein said baffle means is arranged to direct at least a portion of the air entering said inlet means from said one side toward the front center of the space under said hearth floor.

6. The invention according to claim 5 and further including a substantially planar sheet horizontally arranged to divide the space under said hearth floor into upper and lower portions.

7. The invention according to claim 6 wherein said baffle means are arranged in said upper portion of the space under said hearth floor.

8. The invention according to claim 1 wherein said combustion chamber further includes two side walls and a rear wall, each having a front surface facing said combustion chamber, and a rear surface, and means defining an enclosed space behind each of said walls communicating with said air passage.

9. The invention according to claim 8 wherein a portion of said air flow passage is defined by one surface of a member having an opposite surface defining a portion of the enclosed space behind one of said side walls, said member having openings therein through which said air flow passage communicates directly with the space behind said side wall, said air flow passage communicating with the space behind said rear wall through the space under said hearth floor.

10. The invention according to claim 9 and further including a second wall defining the side of the open front of said combustion chamber opposite said one side, and having an internal surface defining at least a portion of a second air flow passage having upper and lower ends, a second opening in said second wall for flow of air into said second air flow passage at said upper end thereof, and second inlet means through which said second air flow passage communicates at said lower end thereof with the space under said hearth floor.

* * * * *